US008279249B2

(12) United States Patent
Inoue

(10) Patent No.: US 8,279,249 B2
(45) Date of Patent: Oct. 2, 2012

(54) RECORDING HEAD AND IMAGE FORMING APPARATUS

(75) Inventor: Michihiro Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 140 days.

(21) Appl. No.: 12/878,680

(22) Filed: Sep. 9, 2010

(65) Prior Publication Data

US 2011/0205327 A1 Aug. 25, 2011

(30) Foreign Application Priority Data

Feb. 23, 2010 (JP) ..... 2010-037799

(51) Int. Cl.
*B41J 2/45* (2006.01)

(52) U.S. Cl. ..... 347/238

(58) Field of Classification Search ..... 347/237, 347/238, 247
See application file for complete search history.

(56) References Cited

U.S. PATENT DOCUMENTS 6,809,752 B2 * 10/2004 Nagamine ..... 347/238
7,042,591 B1 * 5/2006 Yamazaki et al. ..... 358/1.5
8,040,368 B2 * 10/2011 Yokoi ..... 347/242

FOREIGN PATENT DOCUMENTS

JP 2002137437 A * 5/2002
JP 2004-122584 A 4/2004
JP 2006-154076 A 6/2006

* cited by examiner

*Primary Examiner* — Hai C Pham
(74) *Attorney, Agent, or Firm* — Sughrue Mion, PLLC

(57) ABSTRACT

A recording head including: a non-electrically conductive support member; a base board provided above the support member, the base board being provided with light emitting elements for forming an image on a recording medium, a drive section for causing the light emitting elements to emit light, a first earth connection member provided at an end portion of the base board, and a second earth connection member provided at a location of a connection member, having one end connected to a control section for controlling the drive section and another end connected to drive section; a conducting member provided at a predetermined place relative to the support member and connected to an earth; a first conduction section conducting between the conducting member and the first earth connection member; and a second conduction section conducting between the conducting member and the second earth connection member.

11 Claims, 16 Drawing Sheets

RECORDING HEAD AND IMAGE FORMING APPARATUS

CROSS-REFERENCE TO RELATED APPLICATION

This application is based on and claims priority under 35 USC 119 from Japanese Patent Application No. 2010-037799 filed on Feb. 23, 2010.

BACKGROUND

1. Technical Field

The present invention relates to a recording head and an image forming apparatus.

2. Related Art

Conventionally, there is an electronic device which is provided with base boards connected by cables in which cables are connected to the frame ground of the base boards so that the electromagnetic noise radiating from the cables is suppressed.

SUMMARY

According to an aspect of the invention, there is provided a recording head including: a non-electrically conductive support member; a base board provided above the support member, the base board being provided with light emitting elements arrayed along a predetermined direction for forming an image on a recording medium, a drive section for causing the light emitting elements to emit light, a first earth connection member provided at an end portion of the base board on the side of the base board at the side where an earth connection portion is provided to a casing of an image forming apparatus, and a second earth connection member provided at a location of a connection member, having one end connected to a control section for controlling the drive section and another end connected to drive section, the location being at the other end side that is connected to the drive section; a conducting member provided at a predetermined place relative to the support member and connected to the earth connection portion provided to the casing of the image forming apparatus; a first conduction section conducting between the conducting member and the first earth connection member; and a second conduction section conducting between the conducting member and the second earth connection member.

BRIEF DESCRIPTION OF THE DRAWINGS

Exemplary embodiments of the present invention will be described in detail based on the following figures, wherein.

DETAILED DESCRIPTION

First Exemplary Embodiment

Detailed explanation follows of an exemplary embodiment of the present invention, with reference to the drawings.

Figure 1:
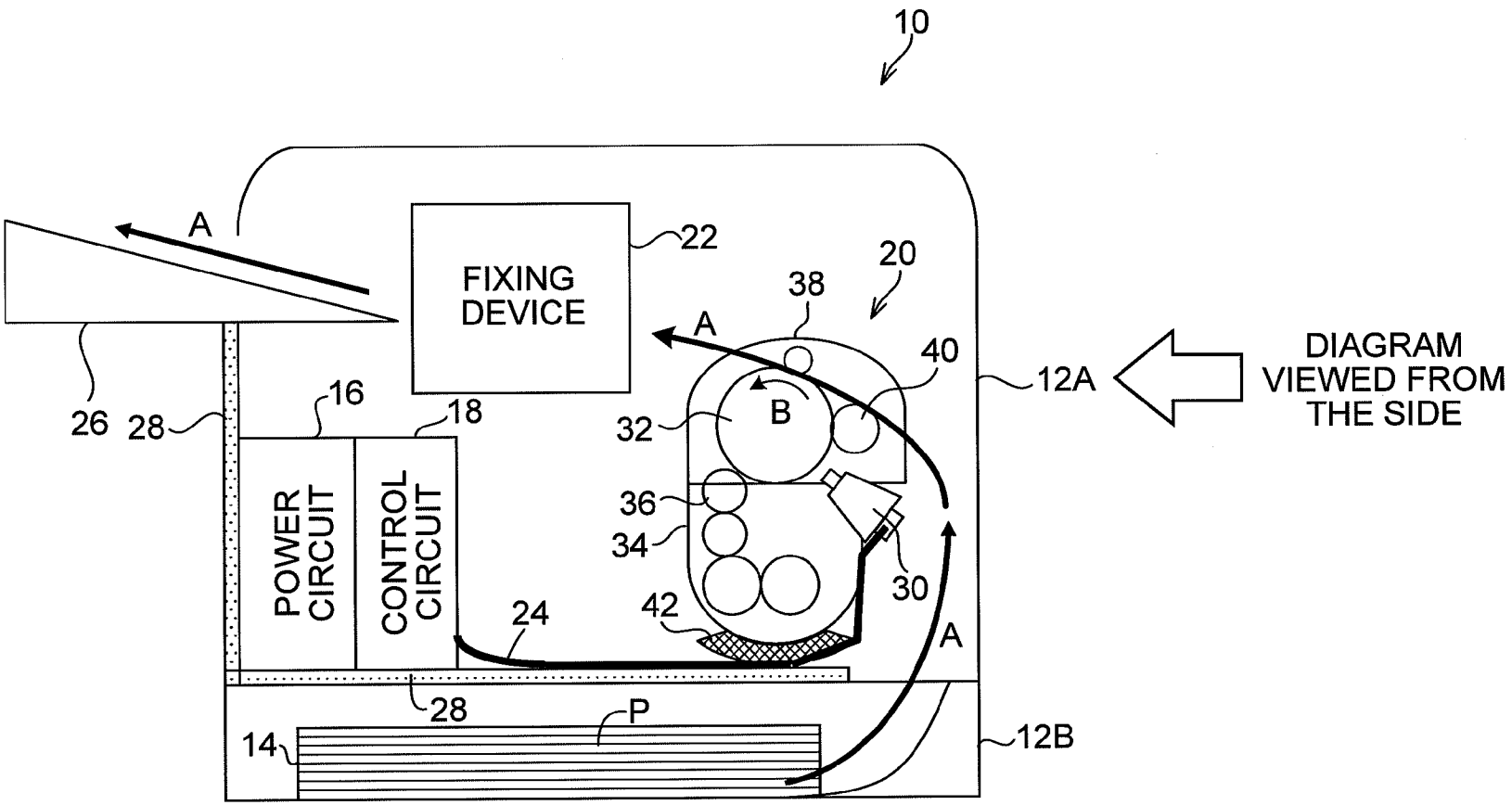
FIG. 1 is a schematic configuration diagram showing an example of a schematic configuration of an image forming apparatus, according to a first exemplary embodiment.
Figure 2:
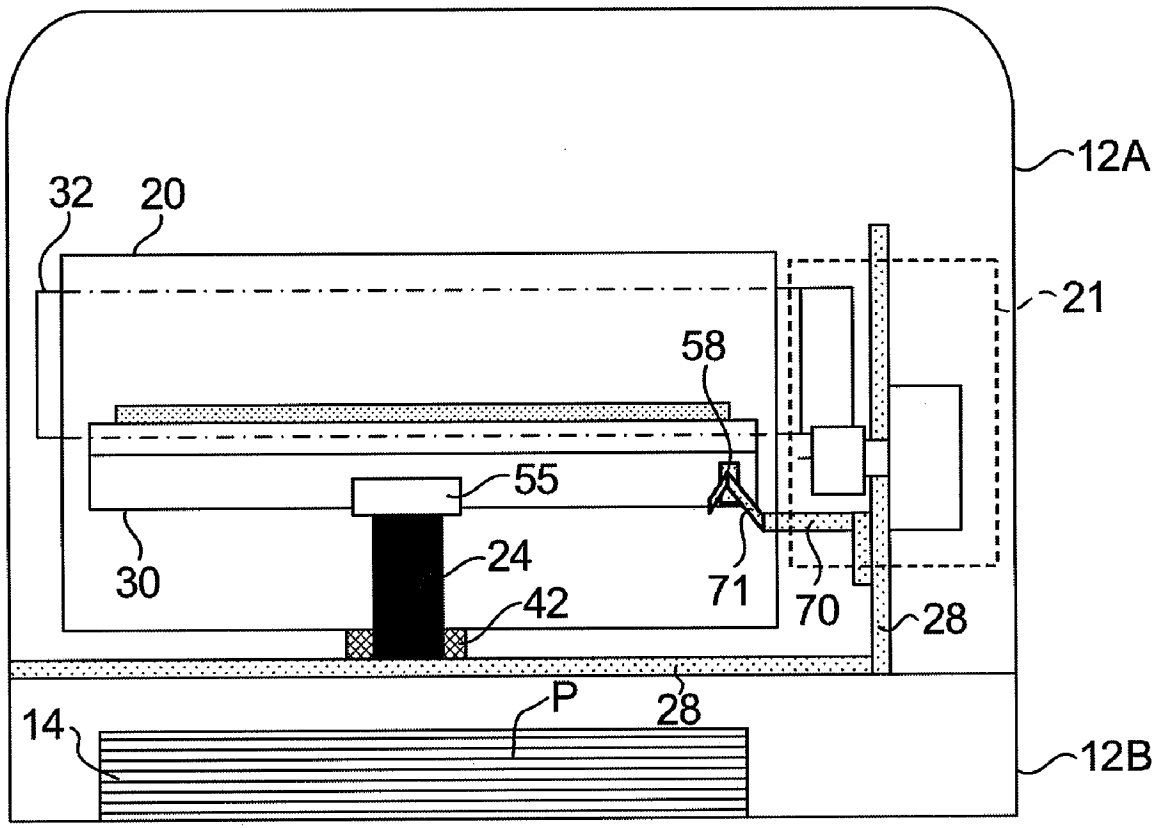
FIG. 2 is a side view showing an example of a schematic configuration of a side face of the image forming apparatus shown in FIG. 1, according to the first exemplary embodiment.

First, explanation follows regarding a configuration of an image forming apparatus 10 according to the present exemplary embodiment. A schematic configuration diagram of an example of an image forming apparatus according to the present exemplary embodiment is shown in FIG. 1. FIG. 2 shows a side view of an example of a schematic configuration of the image forming apparatus 10 shown in FIG. 1, as viewed from the side view direction. Note that in FIG. 2, in order to avoid complicating the side view, illustration is omitted of a fixing device 22, a discharge container 26, and positions of a metal plate 28 located below the discharge container 26.

The image forming apparatus 10 of the present exemplary embodiment is, as a specific example thereof, a monochrome printer for forming a monochrome image on recording paper P, and is one that forms a toner image corresponding to black (K) on the recording paper P.

The image forming apparatus 10 of the present exemplary embodiment is equipped with a paper supply container 14, a power circuit 16, a control circuit 18, a marking unit 20, a marking unit drive section 21, and a fixing device 22. The power circuit 16, the control circuit 18, the marking unit 20, the marking unit drive section 21 and the fixing device 22 are installed within a casing 12A, and the paper supply container 14 is installed within a casing 12B. Reference is simply made below to a casing 12 as a general term to refer to the casings 12A, 12B. The casing 12 is formed from a non-electrically conductive material, and as a specific example in the present exemplary embodiment, is a plastic cover formed from a non-electrically conductive plastic through which electricity does not pass. The metal plate 28 (referred to below as FG 28) configures a frame ground for making the casing 12 overall at the earth electrical potential (earth connection electrical potential) is provided to a portion of the internal wall of the casing 12. In the present exemplary embodiment, as a specific example, the FG 28 is provided in three directions, as shown in FIG. 1 and FIG. 2, at a lower portion of the casing 12A, at a side wall at the side to which the discharge container 26 is installed and at a side wall (not shown in the figures) at the side to which the marking unit drive section 21 is provided (the face at the far side of the image forming apparatus 10 in FIG. 1).

The power circuit 16 includes a power circuit for supplying power to each section provided to the image forming apparatus 10, such as, for example, the marking unit 20, the fixing device 22, and the like. The control circuit 18 includes circuit(s) of, for example, a CPU, ROM, RAM and the like, for controlling the image forming apparatus 10 overall.

The paper supply container 14 is a container accommodating recording paper P for recording images. In the present exemplary embodiment, the recording paper P is conveyed out from the paper supply container 14 in the arrow A direction shown in FIG. 1.

The marking unit 20 is driven by the marking unit drive section 21 and forms a toner image on the recording paper P. The marking unit 20 of the present exemplary embodiment is configured including a LED print head (referred to below as LPH) 30, a photoreceptor 32, a developing device 34, a transfer roller 38, and a charging roller 40. The photoreceptor 32 rotates at a predetermined velocity in the arrow B direction. The charging roller 40 is disposed at the peripheral face of the photoreceptor 32, in order to charge the surface of the photoreceptor 32 to a predetermined electrical potential. The charging roller 40 is an electrically conductive roller, and is disposed such that its peripheral face makes contact with the peripheral face of the photoreceptor 32.

The LPH 30 is a recording head provided at the peripheral face of the photoreceptor 32 for forming an electrostatic latent image on the photoreceptor 32, and is equipped for light sources with Light Emitting Diodes (LEDs) as light emitting elements. The LPH 30 forms an electrostatic latent image on the photoreceptor 32 by illuminating light beams onto the photoreceptor 32 according to image data. Detailed explanation is given below, however, as shown in FIG. 2, the LPH 30 has a long thin shape, extending such that one length direction end thereof faces a side at which the FG 28 is provided, and the other end faces a side at which the FG 28 is not provided. The LPH 30 is connected so as to conduct to the FG 28 using an earth connection pad 58, a metal plate 70 and a metal spring 71.

A LPH harness 24 is connected to the LPH 30 using a connector 55, and the LPH 30 is connected to the control circuit 18 by the LPH harness 24. In the present exemplary embodiment, the LPH harness 24 is pressed against the FG 28 by the marking unit 20, through a resilient member 42, so as to make contact with the FG 28 provided to the casing 12A. Specific examples of the resilient member 42 include, for example, sponge or the like.

Also disposed at the peripheral face of the photoreceptor 32 is the developing device 34 that develops the electrostatic latent image formed on the photoreceptor 32 using black (K) toner and forms a toner image. The developing device 34 is configured including a developing roll 36. A developing bias is applied to the developing roll 36 and the toner (not shown in the figures) filled in the developing device 34 adheres to the peripheral face of the developing roll 36. The toner adhered to the developing roll 36 is conveyed onto the surface of the photoreceptor 32 and the toner is rubbed off onto the photoreceptor 32, thereby developing the electrostatic latent image formed on the photoreceptor 32.

Also disposed at the peripheral face of the photoreceptor 32 is the transfer roller 38 for transferring the toner image on the photoreceptor 32 onto the recording paper P.

The fixing device 22 is a device for fixing toner images by fusing the toner of toner images formed on the recording paper P by the marking unit 20, and pressing the toner images onto the recording paper P. Monochrome images are thereby formed on the recording paper P. The recording paper P formed with the image is externally discharged from the image forming apparatus 10 (to the discharge container 26).

Figure 3:
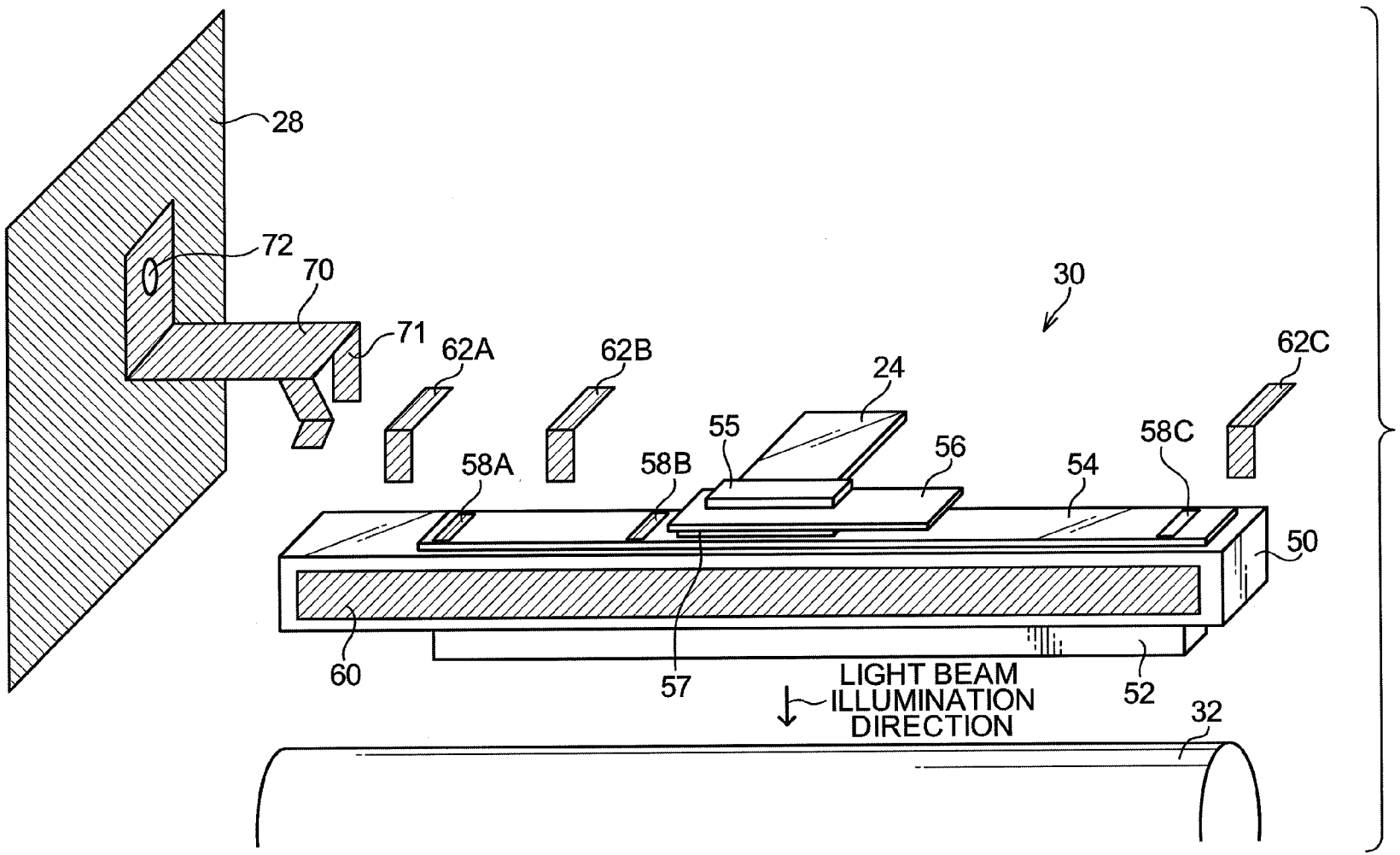
FIG. 3 is a schematic configuration diagram showing an example of a schematic configuration of an LPH, according to the first exemplary embodiment.

Next, explanation follows regarding a configuration of the LPH 30 of the present exemplary embodiment. FIG. 3 shows a schematic configuration diagram of an example of a LPH 30 of the present exemplary embodiment. The LPH 30 of the present exemplary embodiment is equipped with a housing 50 provided with an LED base board 54 that is a printed circuit board on which plural LEDs are arrayed in a predetermined direction, and with a rod lens array 52 of plural arrayed imaging elements for focusing light emitted from the LEDs onto the photoreceptor 32. The housing 50 is a support member for supporting the LED base board 54, the rod lens array 52, and the like, and is formed in a long thin shape along the LED array direction from a non-electrically conductive material (plastic, as a specific example thereof).

While omitted from the drawings, the LEDs in the present exemplary embodiment are plural individual LEDs arrayed, for example, in a staggered pattern along the length direction of the photoreceptor 32 (a predetermined direction). The rod lens array 52 is configured from imaging lenses that are gradient index rod lenses arrayed so as to correspond to each pixel (dot) according to the resolution. The rod lens array 52 focuses the light beams emitted from each of the LEDs onto the photoreceptor 32.

A drive circuit base board 56 is a base board provided with a circuit for driving the LEDs. The LPH harness 24 is connected to the drive circuit base board 56 by the connector 55, and, for example, a control signal for driving the LEDs is input from the control circuit 18 to the drive circuit base board 56 by the LPH harness 24. Thus, in the present exemplary embodiment, the LED base board 54 and the drive circuit base board 56 are formed as separated individual base boards, and the drive circuit base board 56 is connected to a central portion of the LED base board 54 by a connector 57. The connector 57 is a board-to-board connector for connecting a base board to another base board, a so-called B to B connector.

Earth connection pads 58A, 58B, 58C are, as shown in FIG. 3, provided as three earth connection members to the LED base board 54 of the present exemplary embodiment. In the present exemplary embodiment, as a specific example, the earth connection pads 58A, 58B, 58C are configured with copper in an exposed state. The earth connection pad 58A is provided at an end portion of the LED base board 54 on the FG 28 side. The earth connection pad 58B is provided to the LED base board 54 in the vicinity of where the LPH harness 24 is connected (at the side on the FG 28 side of the connector 57 in the present exemplary embodiment). The earth connection pad 58C is provided at an end portion of the LED base board 54 at the side away from the FG 28.

A conducting body 60 is also disposed at one of the side faces of the housing 50, as shown in FIG. 3. Specific examples of the conducting body 60 include adhesive applied tape, a plate member, a coated agent or the like of a conducting body, such as, for example, aluminum, copper or the like. The earth connection pads 58A, 58B, 58C and the conducting body 60 are connected so as to conduct by each of connection members 62A, 62B, 62C, respectively. Specific examples of the connection members 62A, 62B, 62C include conductive adhesive applied tape (such as aluminum tape, copper tape) or the like.

Figure 4:
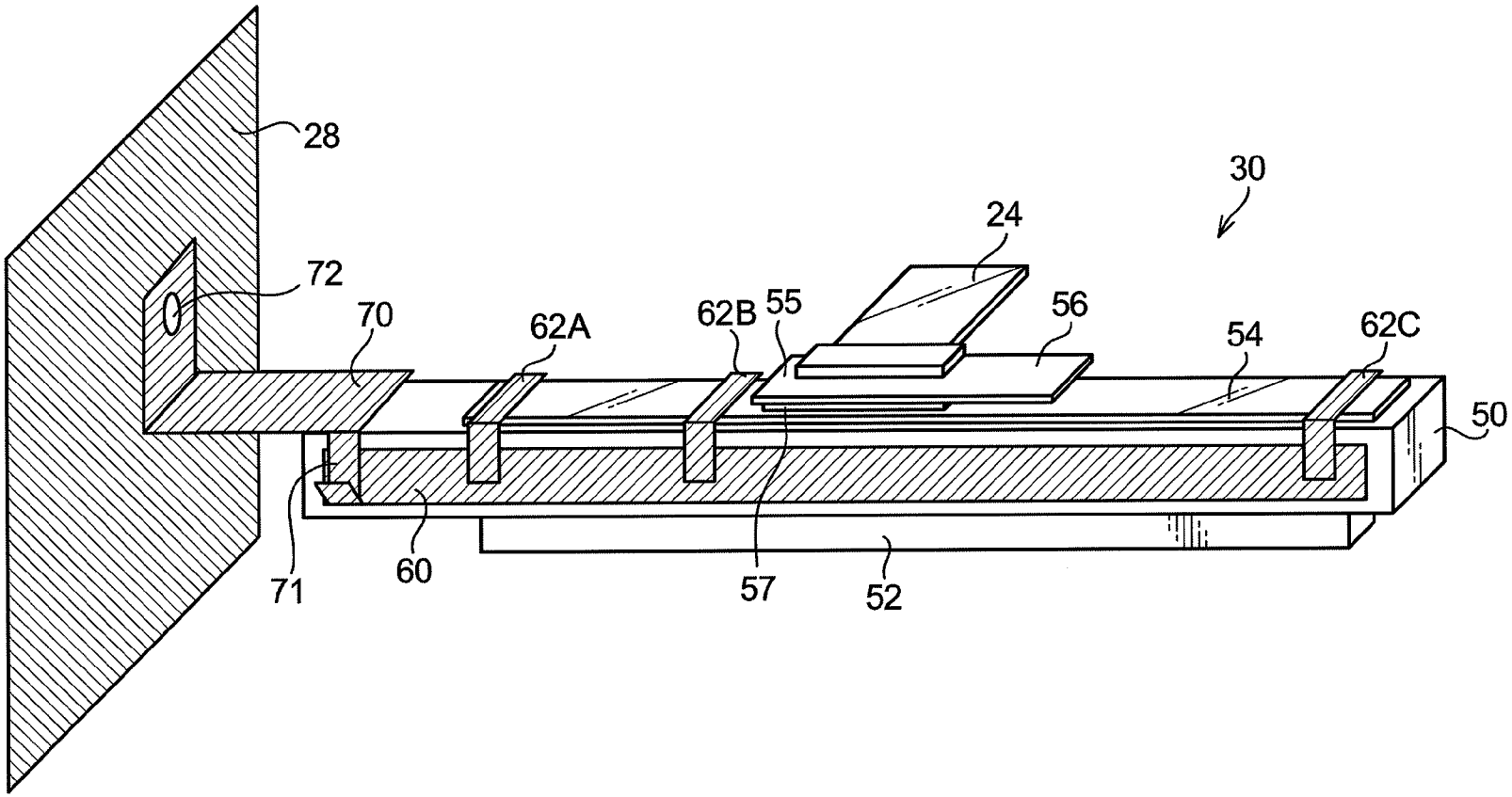
FIG. 4 is an explanatory diagram for explaining a connected state of a conducting body of an LPH and an FG of an image forming apparatus, according to the first exemplary embodiment.

The conducting body 60 is connected to the FG 28 (to the side wall of the face at the far side of the image forming apparatus 10 in FIG. 1) by the screw 72 fastened metal plate 70 and metal spring 71. The conducting body 60 is shown in FIG. 4 in a state connected to the FG 28 with the metal plate 70 and the metal spring 71.

Figure 5:
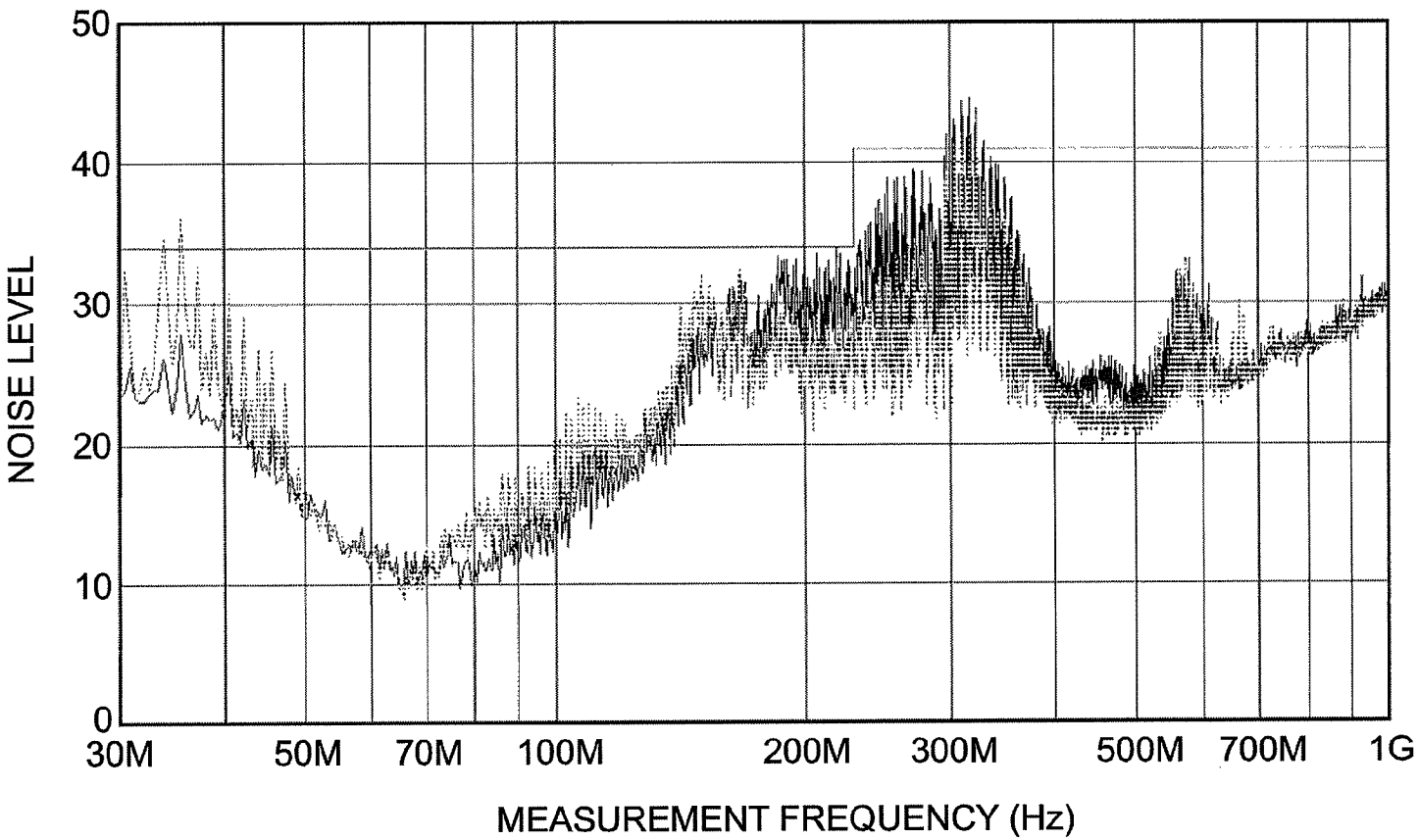
FIG. 5 is an explanatory diagram showing an example of electromagnetic noise of an LPH, according to the first exemplary embodiment.
Figure 6:
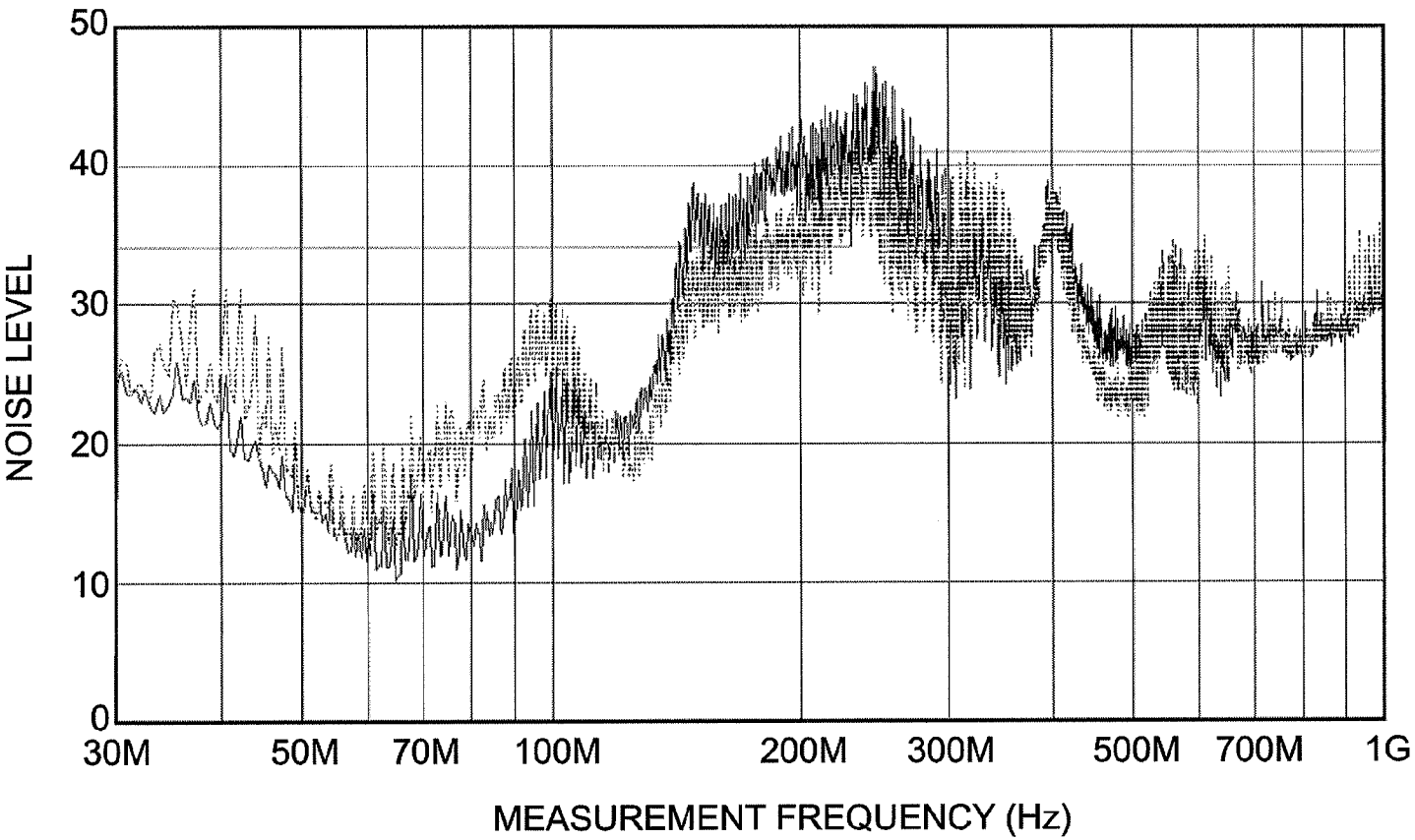
FIG. 6 is an explanatory diagram showing, as a Comparative Example, an example of electromagnetic noise of a conventional LPH not provided with a conducting body (not connected to the FG of an image forming apparatus)

The electromagnetic noise radiating from the LPH 30 of the present exemplary embodiment is shown in FIG. 5, and, as a Comparative Example, the electromagnetic noise radiating from an LPH not provided with the conducting body 60 (not connected to the FG 28) is shown in FIG. 6. Electromagnetic noise is suppressed in the LPH 30 of the present exemplary embodiment, as can be seen from comparison of measurement frequencies 100 MHz and 200 MHz.

Generally, when current flows in a structural member having a long thin shape, the structural member acts as an antenna, and electromagnetic noise is radiated. Electromagnetic noise is effectively suppressed by connecting the two length direction ends of the structural member (the housing 50) to a conductive body (the FG 28), as in the present exemplary embodiment.

Namely, in the present exemplary embodiment, due to the conducting body 60 being disposed at the side face (the side face along the LED disposed direction) of the long thin shaped housing 50, the conducting body 60 being connected to the earth connection pad 58A provided at an end portion of the LED base board 54 on the FG 28 side, to the earth connection pad 58B provided in the vicinity of the connector 57 and to the earth connection pad 58C provided at an end portion at the opposite end side to that of the FG 28, respectively, and due to further connection to the FG 28, a face capacity-coupled to the LED base board 54 is secured in which noise radiating due to electromagnetic resonance of the housing 50 causes an alternating (AC) return current to flow, cancelling out noise.

Accordingly, electromagnetic noise is suppressed even if the housing 50 is a non conducting body. Electromagnetic noise is also suppressed even when the image forming apparatus 10 is not shielded overall by metal. There are generally cases where plastic, a non conducting body, is employed at the material of the casing 12, in order to reduce manufacturing cost by reducing the amount of metal employed, however, electromagnetic noise is suppressed even in such cases.

In addition, in the present exemplary embodiment, electromagnetic noise radiating from the LPH harness 24 is suppressed due to the LPH harness 24 being contacted with the FG 28 by the marking unit 20 acting through the resilient member 42, even without, for example, an earth connection line (not shown in the figures) connecting the LPH harness 24 to the FG 28. Note that, as shown in the present exemplary embodiment, preferably the LPH harness 24 is made to make close contact with the FG 28 at a position close to the LPH 30.

Figure 7:
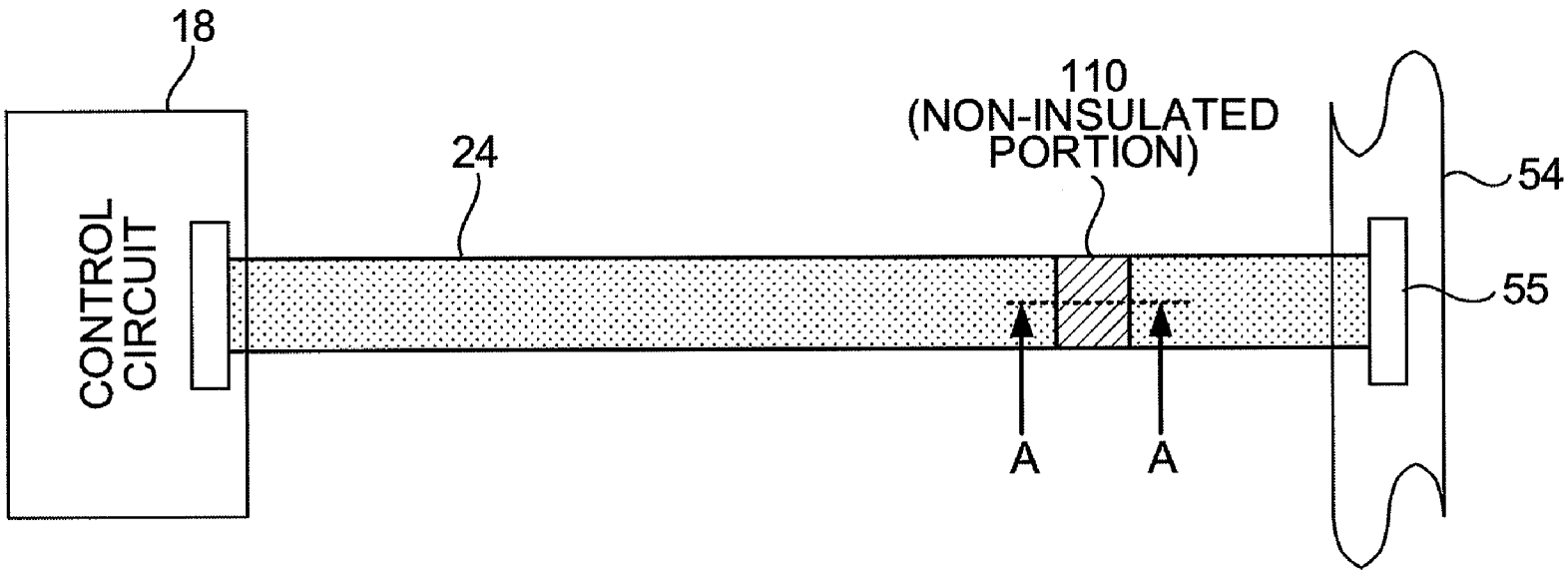
FIG. 7 is an explanatory diagram for explaining a specific example of an LPH harness to which an electromagnetic shielding member is provided, according to the first exemplary embodiment.
Figure 8:
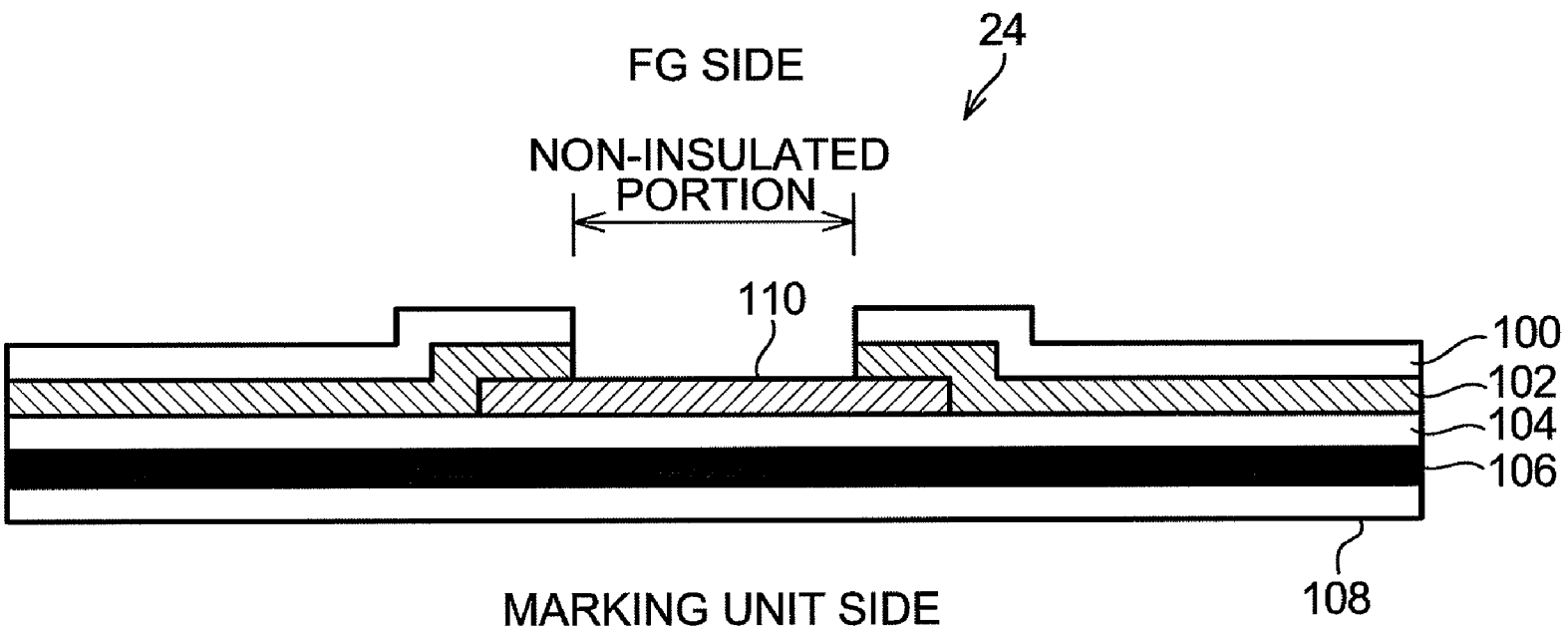
FIG. 8 is a cross-section showing a specific example of the LPH harness shown in FIG. 7, taken on section A-A, according to the first exemplary embodiment.
Figure 9:
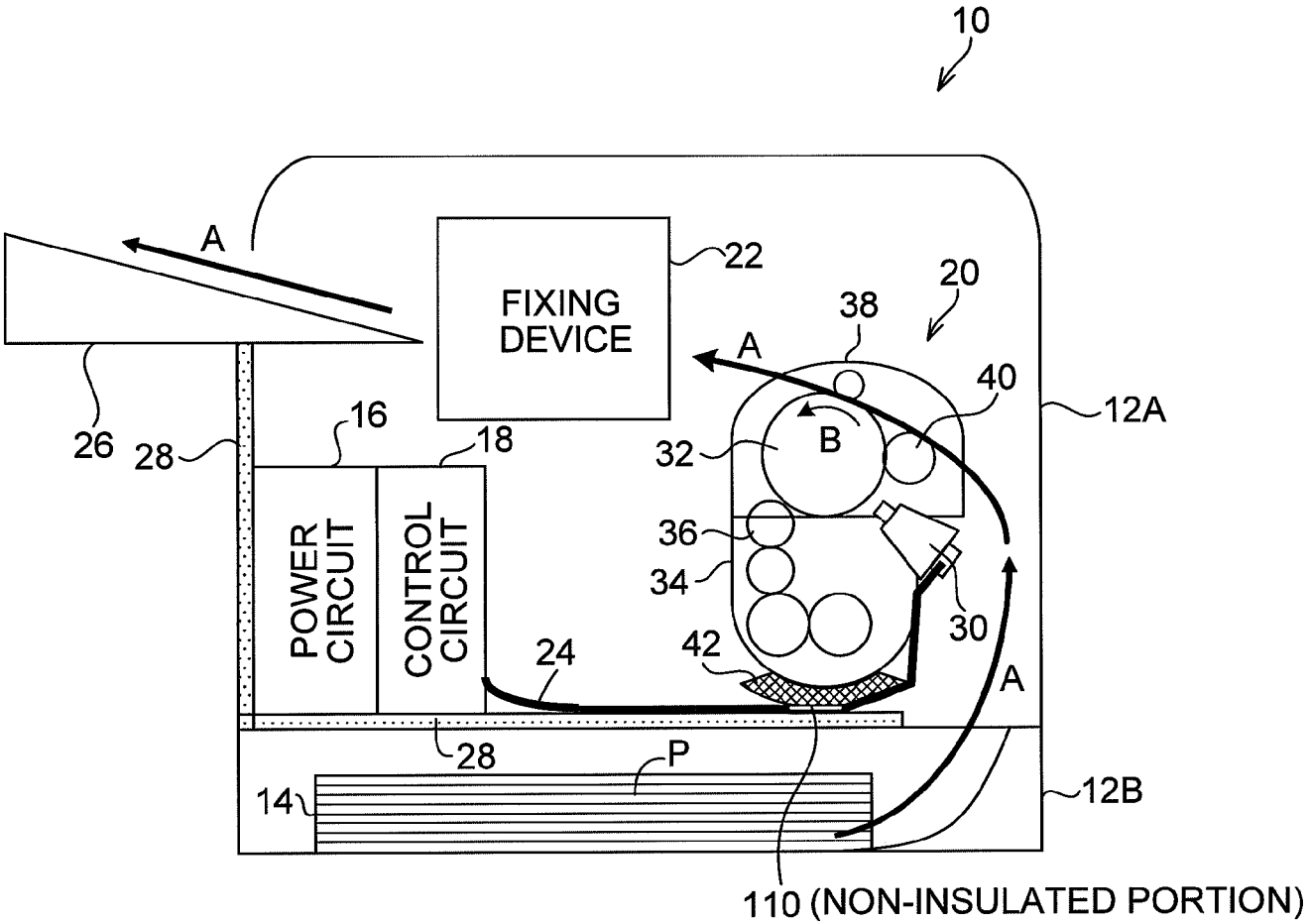
FIG. 9 is a schematic configuration diagram showing an example of a schematic configuration of an image forming apparatus applied with an LPH harness provided with a electromagnetic shielding member, according to the first exemplary embodiment.

Electromagnetic noise is further suppressed by providing an electromagnetic shielding member on the surface of the LPH harness 24. By making close contact, and electrically connecting, the electromagnetic shielding member with the FG 28, electromagnetic noise is suppressed across a wide range from low frequencies to high frequencies. Specific examples of the LPH harness 24 provided with such a shielding member are shown in FIG. 7 and FIG. 8. FIG. 8 is a cross-section showing a specific example of the LPH harness 24 shown in FIG. 7, taken on section A-A, and the top side in FIG. 8 is the side that makes contact with the FG 28. FIG. 9 shows a schematic configuration diagram of an example of the image forming apparatus 10 applied with the LPH harness 24 provided with shielding member.

As shown in FIG. 8, the LPH harness 24 of the present exemplary embodiment is a flat cable, with the face on the FG 28 side of a signal line 106, this being a conducting body for transmitting a control signal from the control circuit 18 to the LED base board 54, covered with an insulating body 104, and the face on the marking unit 20 side of the signal line 106 covered by an insulating body 108. An electrically conductive electromagnetic shielding member 102 and a conducting member 110 are provided on the top face of the insulating body 104, as shown in FIG. 8. Specific examples of the electromagnetic shielding member 102 include conductive adhesive applied aluminum foil or the like. The conducting member 110 is provided in a location that makes contact with the FG 28, and a specific example of the conducting member 110 includes copper foil or the like.

Furthermore, as shown in FIG. 8, an insulating film 100 is provided on the top face of the electromagnetic shielding member 102. The insulating film 100 has the function of preventing shorting of an electrical circuit of another component were the electromagnetic shielding member 102 to make contact with the other component in the image forming apparatus 10. Since the surface of the LPH harness 24 is in an insulated state in this manner, a non insulated section is formed where the insulating film 100 is not provided at the location of contact with the FG 28 (the location where the conducting member 110 is provided) in order to electrically connect the FG 28 and the electromagnetic shielding member 102.

Furthermore, in the present exemplary embodiment, since the LPH harness 24 is caused through the resilient member 42 to make contact with the FG 28, vibration of the marking unit 20 is suppressed from propagating to the casing 12A, and deterioration of image quality of the images formed by the image forming apparatus 10 is prevented.

Furthermore, in the present exemplary embodiment, due to the LED base board 54 and the drive circuit base board 56 being configured from separate individual base boards, the circuit pattern density of the base boards is reduced, in comparison to cases where the LED base board 54 and the drive circuit base board 56 are the same base board. Furthermore, even if driving conditions change, this is accommodated by changing one or other of the LED base board 54 or the drive circuit base board 56.

Further still, in the present exemplary embodiment, a central portion (the earth connection pad 58B) of the LED base board 54 is caused to be in conduction with the FG 28 and is at the earth electrical potential, and with the portions at both ends of the LED base board 54 as nodes, and the central portion of the LED base board 54 as an anti-node, since an earth electrical potential is provided at the portion of the anti-node of electromagnetic resonance, electromagnetic noise is further suppressed.

In the present exemplary embodiment, explanation has been given of a case in which the image forming apparatus 10 forms a single color (black) image on the recording paper P, there is no limitation thereto. In cases of an image forming apparatus that forms an image of plural colors (colored image) on the recording paper P, in order to form toner images of each of the colors on the recording paper P configuration may be made with one of the marking units 20 for each of the colors. Furthermore, whilst explanation has been given in the present exemplary embodiment of a case of direct image formation on the recording paper P there is no limitation thereto, and an intermediate transfer body may be employed.

Furthermore, while the conducting body 60 in the present exemplary embodiment is disposed at one face of the housing 50 there is no limitation thereto. Configuration may be made so as to dispose the conducting body 60 on the face disposed with the rod lens array 52 facing the photoreceptor 32, or so as to dispose the conducting body 60 on any side face other than the face on which the LED base board 54 is disposed. Furthermore, while the conducting body 60 in the present exemplary embodiment is directly adhered to the housing 50 there is no limitation thereto, and the conducting body 60 may be disposed at a predetermined distance from the housing 50. Such a predetermined distance is a distance arrived at as a distance that suppresses electromagnetic noise by, for example, prior testing or the like, and is generally 5 mm or greater.

Second Exemplary Embodiment

Figure 10:
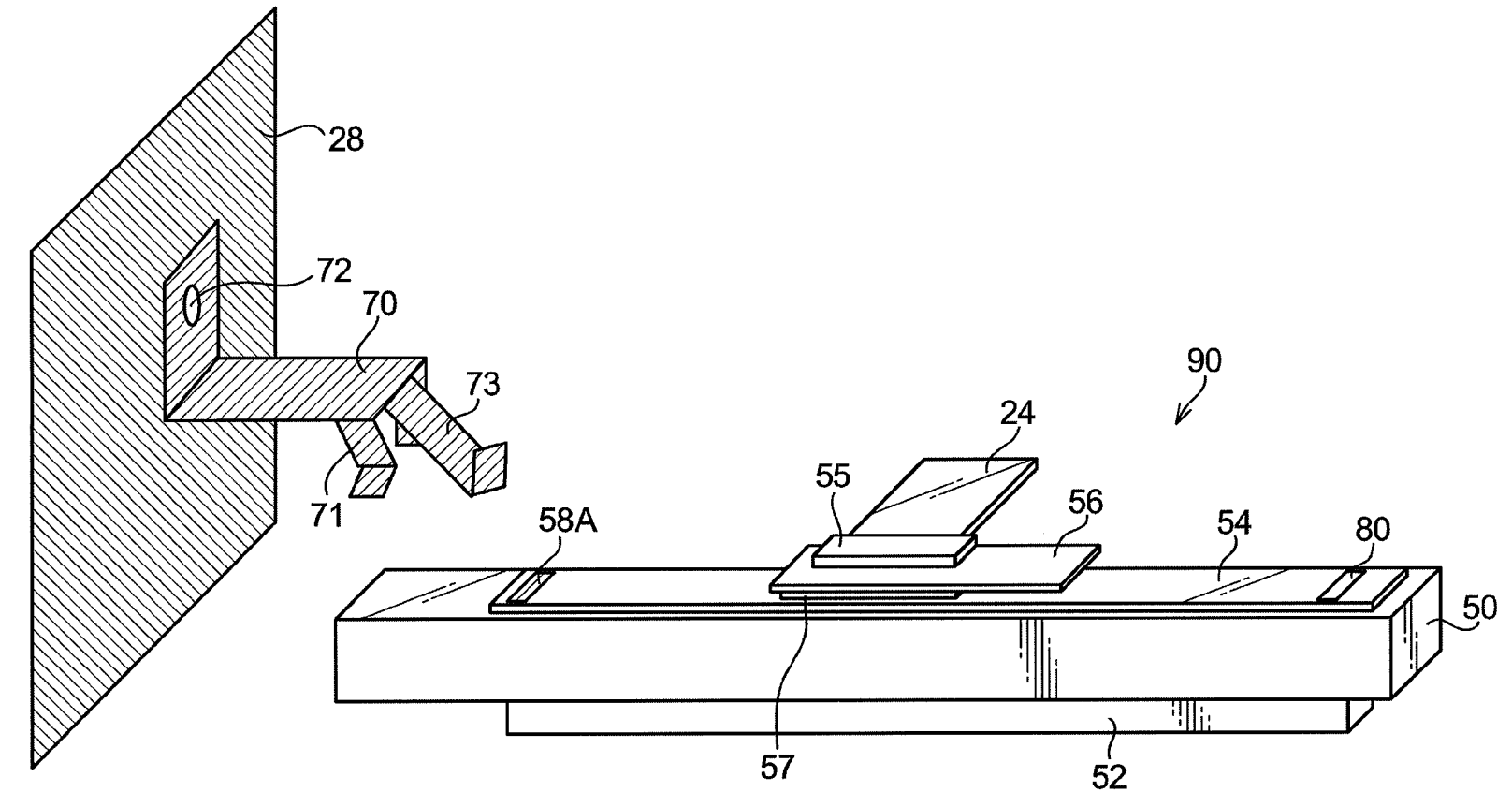
FIG. 10 is a schematic configuration diagram showing an example of a schematic configuration of an LPH, according to a second exemplary embodiment.

Explanation follows regarding an LPH in another exemplary embodiment. A schematic configuration diagram of an example of the LPH of the present exemplary embodiment is shown in FIG. 10. Since an LPH 90 of the present exemplary embodiment is configured substantially the same as the LPH 30 of the first exemplary embodiment, the same reference numerals are appended to similar portions, and detailed explanation thereof is omitted.

Figure 11:
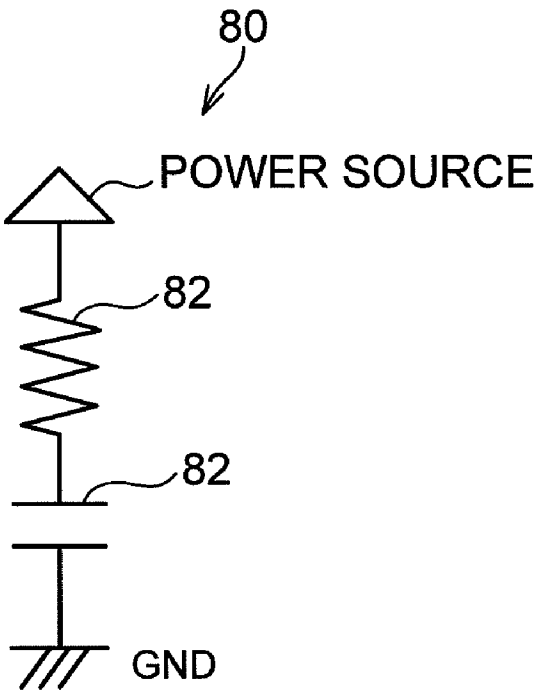
FIG. 11 is a schematic configuration diagram showing an example of a snubber circuit, according to the second exemplary embodiment.

In the LPH 90 of the present exemplary embodiment, instead of the conducting body 60 provided to the LPH 30 of the first exemplary embodiment, a snubber circuit 80 is provided to an end portion of the LED base board 54 at the side away from the FG 28. A specific example of the snubber circuit 80 of the present exemplary embodiment is shown in FIG. 11. The snubber circuit 80 is configured including a resistor 82 and a capacitor 84, such as a condenser or the like. The capacitance of the capacitor 84 is determined, for example, according to the illumination period of the LEDs or the like.

An earth connection pad 58A is also provided to the LED base board 54, and the FG 28 and the LED base board 54 are electrically connected by a metal spring 73 attached to a metal plate 70.

In the LPH 90 of the present exemplary embodiment such as this, since the FG 28 and the earth connection pad 58A provided at the end portion on the FG 28 side of the LED base board 54 are connected, and the snubber circuit 80 is provided to the end portion on the opposite side of the LED base board 54 to the side of the FG 28, the snubber circuit 80 AC terminates the return current, and electromagnetic noise radiation by the housing 50 is suppressed.

In the present exemplary embodiment, as a specific example of the snubber circuit 80, configuration with the resistor 82 and the capacitor 84 is shown, however there is no limitation thereto, and other configurations may be adopted.

Third Exemplary Embodiment

Figure 12:
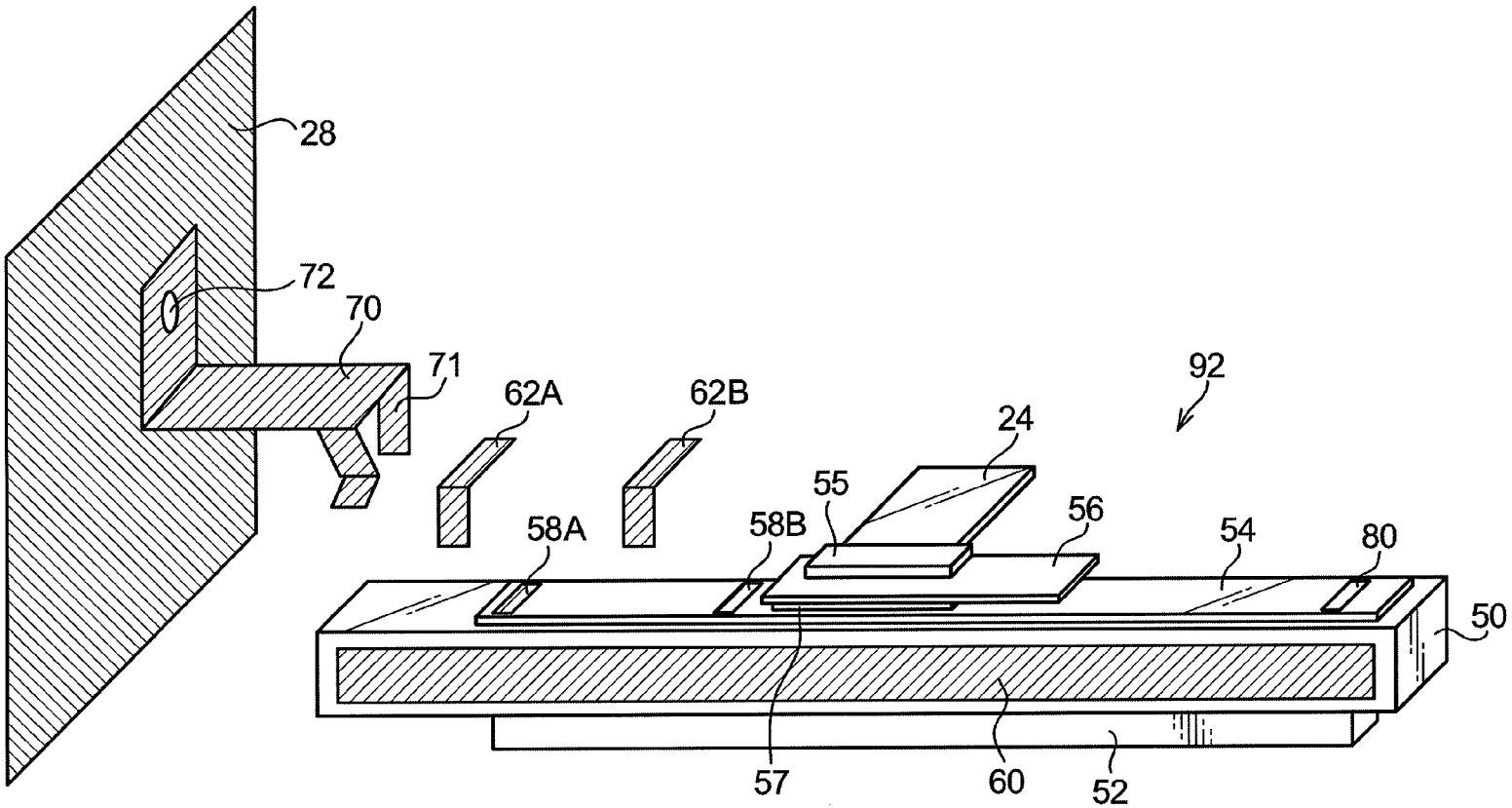
FIG. 12 is a schematic configuration diagram showing an example of a schematic configuration of an LPH, according to a third exemplary embodiment.

Explanation follows regarding an LPH in a further other exemplary embodiment. A schematic configuration diagram of an example of the LPH of the present exemplary embodiment is shown in FIG. 12. Since an LPH 92 of the present exemplary embodiment is configured substantially the same as the LPH 30 of the first exemplary embodiment and the LPH 90 of the second exemplary embodiment, the same reference numerals are appended to similar portions, and detailed explanation thereof is omitted.

In the LPH 92 of the present exemplary embodiment, the snubber circuit 80 provided to the LPH 90 of the second exemplary embodiment is provided instead of the earth connection pad 58C provided to the LPH 30 of the first exemplary embodiment.

The LPH 92 of the present exemplary embodiment thereby has a conducting body 60 disposed on the side face of the long thin shaped housing 50, with the conducting body 60 being connected respectively to the earth connection pad 58A provided to the end of the LED base board 54 at the FG 28 side and to the earth connection pad 58B provided in the vicinity of the connector 57, thereby connecting the conducting body 60 to the FG 28. Since, furthermore, a snubber circuit 80 is provided at an end portion at the opposite side of the LED base board 54 to the FG 28 side, electromagnetic noise radiation by the housing 50 is suppressed.

Fourth Exemplary Embodiment

Figure 13:
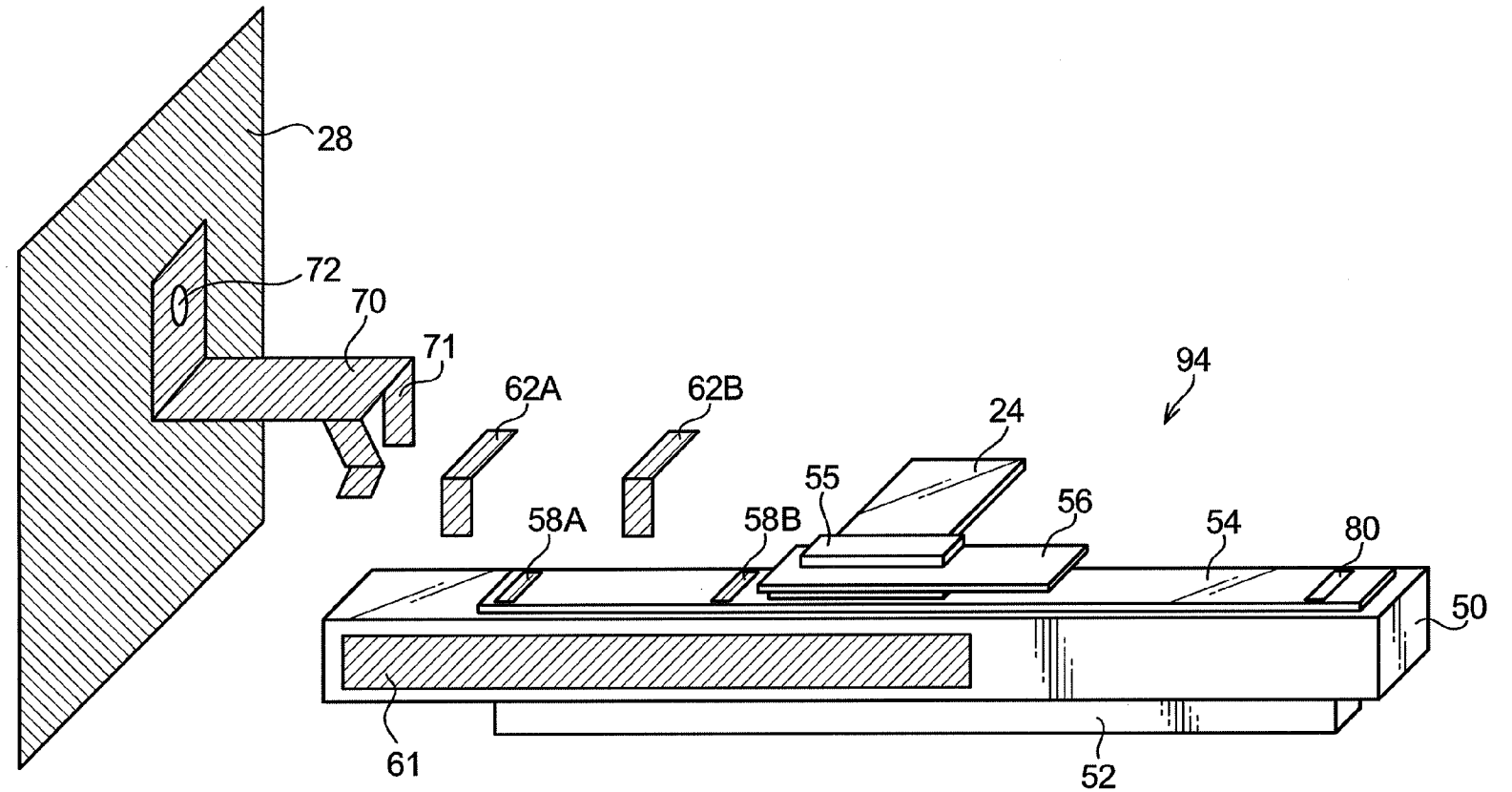
FIG. 13 is a schematic configuration diagram showing an example of a schematic configuration of an LPH, according to a fourth exemplary embodiment.

Explanation follows regarding an LPH in a further other exemplary embodiment. A schematic configuration diagram of an example of the LPH of the present exemplary embodiment is shown in FIG. 13. Since an LPH 94 of the present exemplary embodiment is configured substantially the same as the LPH 30 of the first exemplary embodiment, the LPH 90 of the second exemplary embodiment and the LPH 92 of the third exemplary embodiment, the same reference numerals are appended to similar portions, and detailed explanation thereof is omitted.

In the LPH 94 of the present exemplary embodiment, a conductive body 61 is provided instead of the conducting body 60 provided to the LPH 92 of the third exemplary embodiment. The conductive body 61 of the present exemplary embodiment differs from the conducting body 60 in its length relative to the housing 50, and has a length up to the connection portion where the LPH harness 24 is connected. Specifically, as shown in FIG. 13, the length of the conductive body 61 is from the FG 28 end side of the housing 50 up to, and including, all of the portions where the LPH harness 24 is connected. There is raised impedance of the conductive body 61 and the earth electrical potential at the portion away from the FG 28. Since the impedance is raised when sufficient surface area of a conducting body 60 cannot be secured, it becomes an antenna rather than allowing flow of the return current, and thus electromagnetic noise is radiated. Generally, an impedance that exceeds 5Ω is not preferable for suppressing electromagnetic noise. Therefore, in such cases, the length of the conductive body provided to the housing 50 may be made shorter so that the impedance of the conductive body is not raised. Specifically, the conductive body 61 may be configured with a length from the end portion of the housing 50 at the FG 28 side to the LPH harness 24, and in particular may be configured as a length that extends past the connection portion of the LPH harness 24.

In the LPH 94 of the present exemplary embodiment such as this, in cases where the surface area of the conductive body provided to the housing 50 is small and the impedance is raised, since the length of the conductive body is from the end portion of the housing 50 at the FG 28 side to the LPH harness 24 and the snubber circuit 80 is provided to the end portion of the LED base board 54 at the opposite side to that of the FG 28 side, electromagnetic noise radiation by the housing 50 is suppressed.

Fifth Exemplary Embodiment

Figure 14:
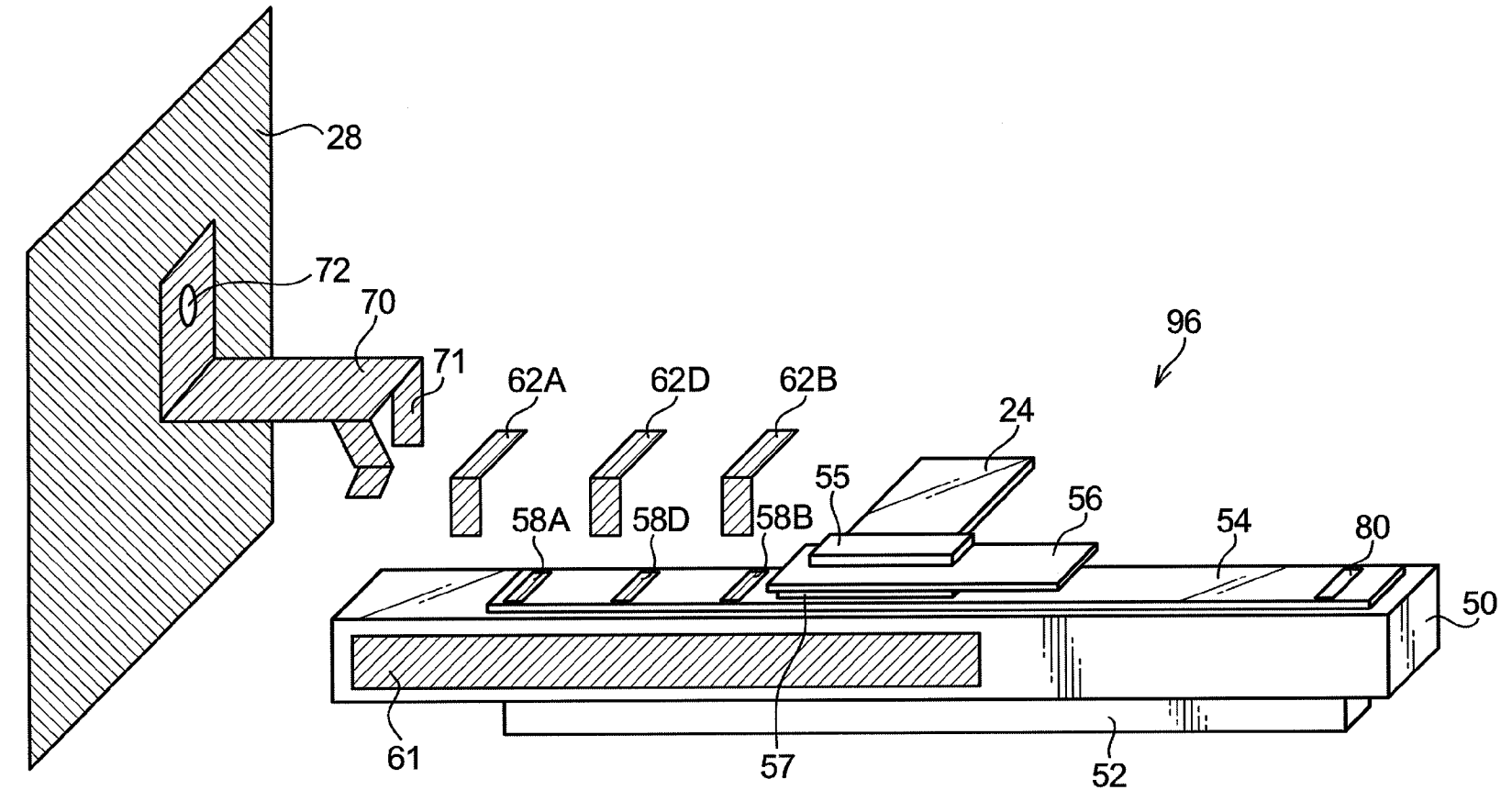
FIG. 14 is a schematic configuration diagram showing an example of a schematic configuration of an LPH, according to a fifth exemplary embodiment.

Explanation follows regarding an LPH in a further other exemplary embodiment. A schematic configuration diagram of an example of the LPH of the present exemplary embodiment is shown in FIG. 14. Since an LPH 96 of the present exemplary embodiment is configured substantially the same as the LPH 30 of the first exemplary embodiment, the LPH 90 of the second exemplary embodiment, the LPH 92 of the third exemplary embodiment and the LPH 94 of the fourth exemplary embodiment, the same reference numerals are appended to similar portions, and detailed explanation thereof is omitted.

The LED base board 54 of the LPH 96 of the present exemplary embodiment is further provided with an earth connection pad 58D between the earth connection pad 58A and the earth connection pad 58B of the LED base board 54 of the LPH 96 of the fourth exemplary embodiment. Furthermore, the earth connection pad 58D and the conductive body 61 are connected together with a connection member 62D.

Figure 15:
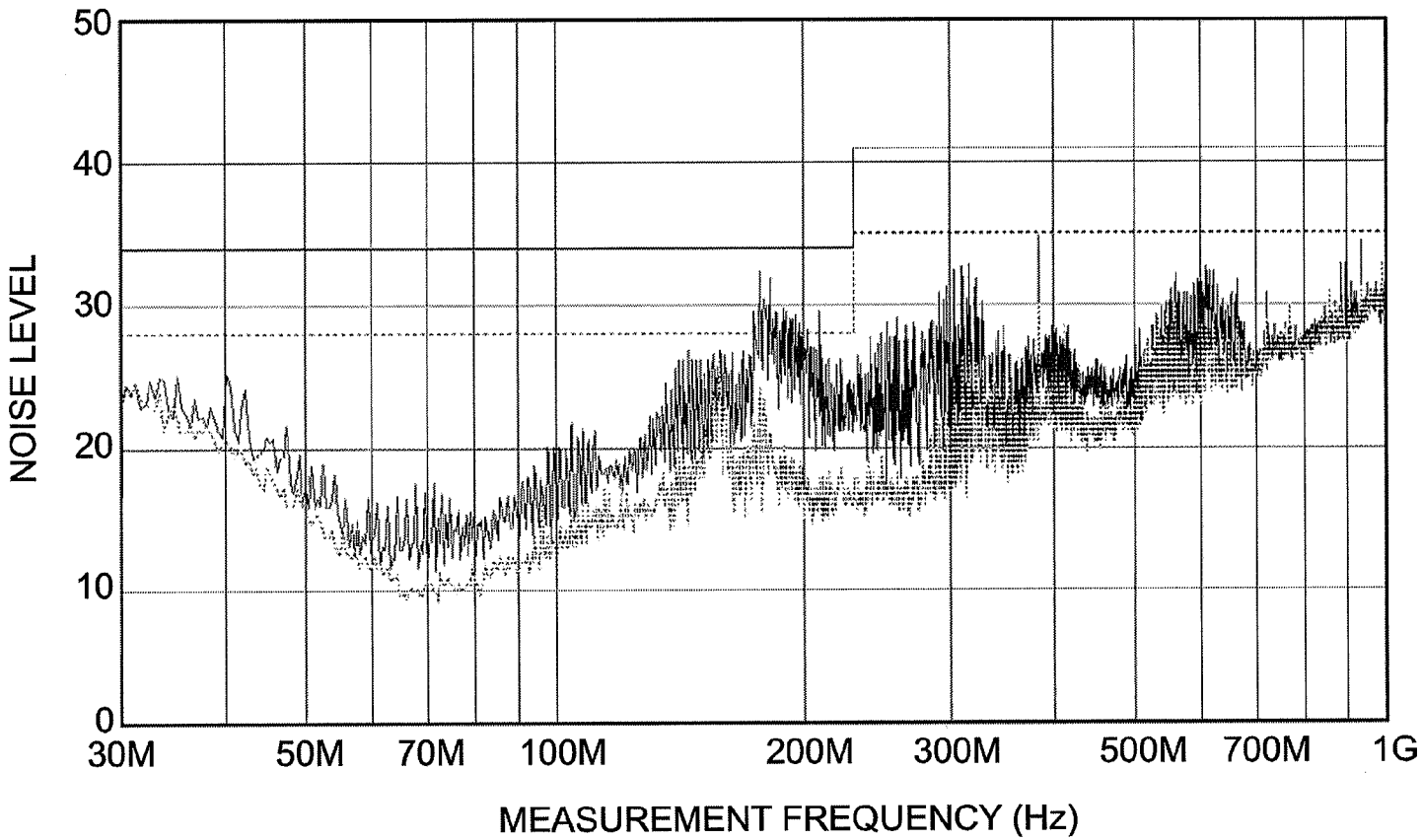
FIG. 15 is an explanatory diagram showing an example of electromagnetic noise of an LPH, according to the fifth exemplary embodiment.
Figure 16:
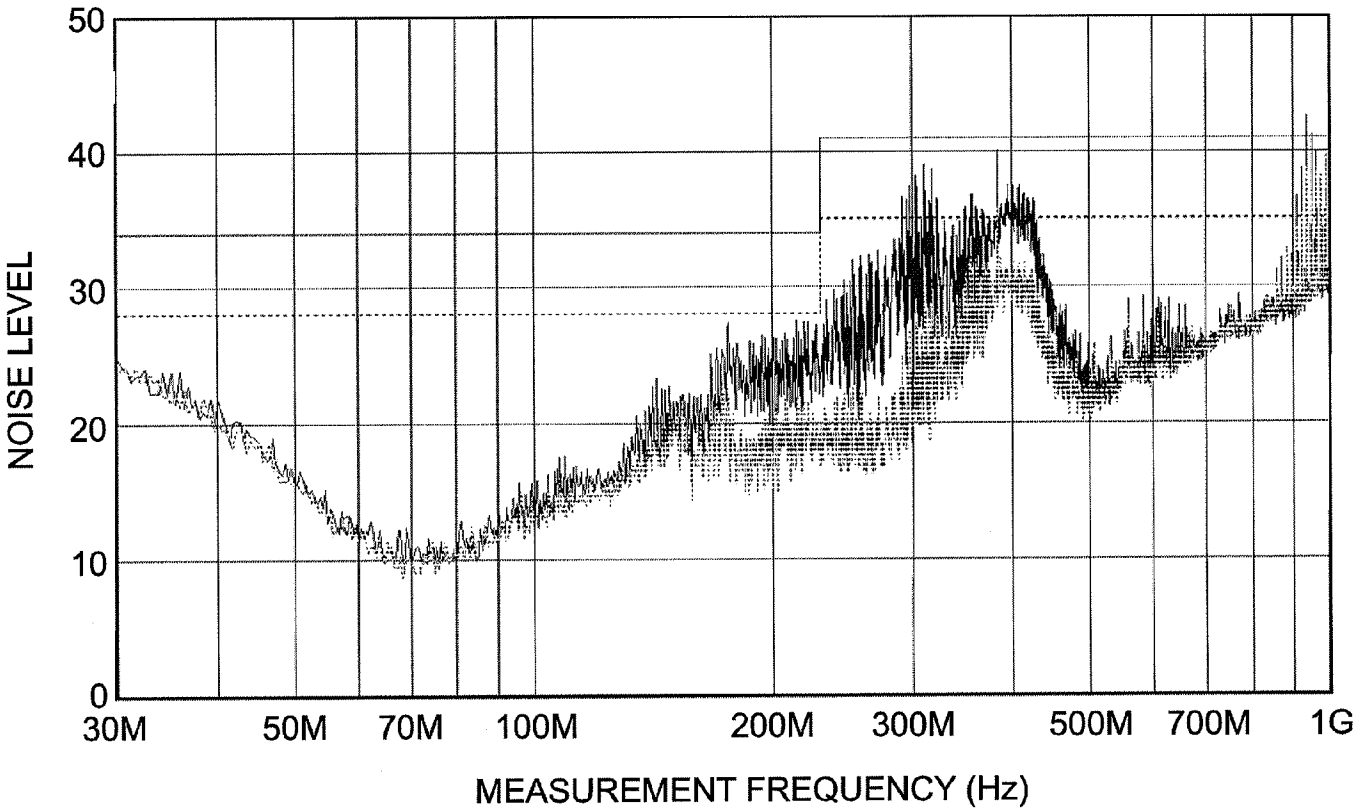
FIG. 16 is an explanatory diagram showing an example of electromagnetic noise of an LPH that is not provided with an earth connection pad.

Electromagnetic noise radiation from the LPH 96 of the present exemplary embodiment is shown in FIG. 15, and, as a Comparative Example, electromagnetic noise radiation from an LPH not provided with the earth connection pad 58D (not connected to a conductive body between the earth connection pad 58A and the earth connection pad 58B) is shown in FIG. 16. As shown in FIG. 15 and FIG. 16, for the Comparative Example, the peak of the electromagnetic noise is in the vicinity of measurement frequency 400 MHz, however, in the LPH 96 of the present exemplary embodiment, the electromagnetic noise is distributed in the vicinity of 180 MHz, 300 MHz and 600 MHz, and it can be seen that the resonance frequency (resonance mode) is changed.

In the present exemplary embodiment such as this, due to providing the earth connection pad 58D between the earth connection pad 58A and the earth connection pad 58B, and connecting the earth connection pad 58D to the conductive body 61 using the connection member 62D, since the resonance mode of the LED base board 54 is changed, the frequency distribution of the electromagnetic noise is changed. Consequently, since electromagnetic noise generated in a particular frequency band is distributed to other frequency bands, electromagnetic noise is distributed so as not to exceed regulation values in the frequency bands shown in radiofrequency radiation and electromagnetic field regulations, such as IEC 61000-4-3, JIS C 1000-4-3, or the like.

What is claimed is:

1. A recording head comprising:

a non-electrically conductive support member;

a base board provided above the support member, the base board being provided with a plurality of light emitting elements arrayed along a predetermined direction for forming an image on a recording medium, a drive section for causing the plurality of light emitting elements to emit light, a first earth connection member provided at an end portion of the base board on the side of the base board at the side where an earth connection portion is provided to a casing of an image forming apparatus, and a second earth connection member provided at a location of a connection member, having one end connected to a control section for controlling the drive section and another end connected to drive section, the location being at the other end side that is connected to the drive section;

a conducting member provided at a predetermined place relative to the support member and connected to the earth connection portion provided to the casing of the image forming apparatus;

a first conduction section conducting between the conducting member and the first earth connection member; and a second conduction section conducting between the conducting member and the second earth connection member.

2. The recording head of claim 1, wherein:

the base board is further provided with a third earth connection member at an end portion of the base board on the opposite side to the end portion where the first earth connection member is provided;

the conducting member is at least as long as the length from the location where the first earth connection member is provided to the location where the third earth connection member is provided; and a third connection member is provided conducting between the conducting member and the third earth connection member.

3. The recording head of claim 1, wherein the base board is further formed with a snubber circuit at an end portion of the base board at the opposite side to the end portion where the first earth connection member is formed.

4. The recording head of claim 3, wherein the conducting member is as long as the length from the location where the first earth connection member is provided to the location at the other end side of the connection member that is connected to drive section.

5. The recording head of claim 1, wherein:

the base board is further formed with a fourth earth connection member between the location where the first earth connection member is provided and the location where the second earth connection member is provided; and a fourth conduction section is provided conducting between the conducting member and the fourth earth connection member.

6. The recording head of claim 1, wherein the base board comprises a first base board formed with the drive section, a second base board formed with the plurality of light emitting elements arrayed along the predetermined direction, the first earth connection member and the second earth connection member, and a connection section that connects the first base board to the second base board.

7. An image forming apparatus comprising:

a casing having at least one non-electrically conductive side face;

an earth connection portion provided to the casing;

an image forming section including the recording head of claim 1 is provided such that one end of the recording head faces the non-electrically conductive side face and another end of the recording head faces the earth connection portion.

8. The image forming apparatus of claim 7, wherein the image forming section is disposed such that the earth connection member makes contact with the earth connection portion.

9. The image forming apparatus of claim 7, wherein the earth connection member comprises a transmission line for transmitting a signal to control the drive section, a first insulating body that covers the transmission line, a conductive member provided to the first insulating body on a face facing the casing, and a second insulating body provided to a surface of the conductive member.

10. The image forming apparatus of claim 9, wherein a portion of the surface of the conductive member makes contact with the earth connection portion.

11. A recording head comprising:

a non-electrically conductive support member;

a base board provided above the support member, the base board formed with a plurality of light emitting elements arrayed along a predetermined direction for forming an image on a recording medium, a drive section for causing the plurality of light emitting elements to emit light, and a snubber circuit formed at an end portion of the base board at an opposite side in the predetermined direction to an end portion of the base board at the side of an earth connection portion provided to a casing of an image forming apparatus; and a conducting member provided at a predetermined place relative to the support member and connected to the earth connection portion provided to the casing of the image forming apparatus.

* * * * *